US008766739B2

(12) United States Patent
Chen et al.

(10) Patent No.: US 8,766,739 B2
(45) Date of Patent: Jul. 1, 2014

(54) MICROWAVE FREQUENCY TUNABLE FILTERING BALUN

(75) Inventors: Jian Xin Chen, Nantong (CN); Hui Tang, Nantong (CN); Li Heng Zhou, Nantong (CN); Jin Shi, Nantong (CN); Zhi Hua Bao, Nantong (CN)

(73) Assignee: Nantong University, Nantong (CN)

( * ) Notice: Subject to any disclaimer, the term of this patent is extended or adjusted under 35 U.S.C. 154(b) by 260 days.

(21) Appl. No.: 13/483,047

(22) Filed: May 30, 2012

(65) Prior Publication Data

US 2013/0200959 A1 Aug. 8, 2013

(30) Foreign Application Priority Data

Feb. 6, 2012 (CN) ..... 2012 1 0025328

(51) Int. Cl.
*H01P 5/10* (2006.01)
*H01P 1/203* (2006.01)
*H01P 7/08* (2006.01)

(52) U.S. Cl.
CPC ..... *H01P 5/10* (2013.01); *H01P 1/20381* (2013.01); *H01P 7/082* (2013.01)
USPC ..... 333/26; 333/205; 333/235

(58) Field of Classification Search
CPC ..... H01P 1/2016; H01P 1/20372; H01P 1/20381; H01P 1/2135; H01P 7/082; H01P 7/088; H01P 7/08
USPC ..... 333/204, 205, 219, 235, 125, 126, 128, 333/134, 136, 25, 26, 33, 35
See application file for complete search history.

(56) References Cited

U.S. PATENT DOCUMENTS 5,017,897 A * 5/1991 Ooi et al. ..... 333/204
5,045,815 A * 9/1991 Avanic et al. ..... 331/96
5,164,690 A * 11/1992 Yeh et al. ..... 333/204
5,361,050 A * 11/1994 Einbinder ..... 333/204

* cited by examiner

*Primary Examiner* — Benny Lee
*Assistant Examiner* — Gerald Stevens

(57) ABSTRACT

A microwave frequency tunable filtering balun is provided. The microwave frequency tunable filtering balun comprises a first microwave split ring transmission line resonator and a second microwave split ring transmission line resonator arranged in a bilaterally symmetrical manner, a fourth variable capacitor and a fifth variable capacitor of same parameters. It combines two functions of balun and tunable bandpass filter (BPF) into one circuit, resulting in a compact design. The balun characteristic and frequency-tuning mechanism are investigated, and the design equations are derived.

7 Claims, 4 Drawing Sheets

MICROWAVE FREQUENCY TUNABLE FILTERING BALUN

FIELD OF THE INVENTION

The present invention relates to microwave communication field and more particularly relates to a microwave frequency tunable filtering balun.

BACKGROUND OF THE INVENTION

Nowadays, a mass of RF/Microwave modules are designed for portable terminals such as handsets, e-readers and tablet PCs. This trend motivates the research of high integration techniques for saving board space, decreasing system costs and simplifying the design effort, especially in the designs of microwave passive components because they occupy most of circuit area. In the past few years, much effort has been paid to offer several effective solutions for high integration techniques. Among them, the combination of two or more independent function circuits into one circuit is one of the popular approaches. For example, the integration of balun and bandpass filter (BPF) not only exhibits the unbalanced-to-balanced conversion, but also bandpass filtering.

In order to bring in fine bandpass response, a variety of resonators are researched. For example, many balun BPFs are evolved from the classic quarter- and half-wavelength resonators with folding topology or the single dual-mode resonators are employed to construct the compact balun BPFs. To cater to the dual-band wireless systems, plenty of research focuses on the balun BPFs with two passbands. To extend the ability of the microwave components for supporting multiple frequency bands, tunable or reconfigurable techniques have drawn much attention for research and development because of their increasing importance in improving the capabilities of current and future wireless communication systems. Accordingly, many tunable BPFs have been under intensive development, but relatively little research has been done on the tunable balun. In particular, up to now, the study concerning the frequency tunable filtering balun with bandpass response is rather sparse.

SUMMARY

The primary objective of the present invention is to provide a microwave frequency tunable balun with bandpass response, aiming at the technical problem in prior art that no frequency tunable filtering balun is excogitated.

According to one aspect, the present invention relates to a microwave frequency tunable filtering balun comprising a first microwave split ring transmission line resonator and a second microwave split ring transmission line resonator arranged in a bilaterally symmetrical manner, a fourth variable capacitor and a fifth variable capacitor of same parameters, wherein, the first microwave split ring transmission line resonator and the second microwave split ring transmission line resonator are vertically symmetrical about a central line, an unbalanced input port is arranged at a top portion of the first microwave split ring transmission line resonator, a first balanced output port and a second balanced output port are arranged in a vertically symmetrical manner at an upper portion and a lower portion of the second microwave split ring transmission line resonator respectively, a distance between the first balanced output port or the second balanced output port and the central lines is smaller than a distance between the unbalanced input port and the central line, the fourth variable capacitor is connected between two open ends of the first microwave split ring transmission line resonator and the fifth variable capacitor is connected between two open ends of the second microwave split ring transmission line resonator.

In the microwave frequency tunable filtering balun according to present invention, the microwave frequency tunable filtering balun further comprises a first variable capacitor, a second variable capacitor and a third variable capacitor, wherein, the first variable capacitor is connected between the unbalanced input port and the upper portion of the first microwave split ring transmission line resonator, the second variable capacitor is connected between the first balanced output port and the upper portion of the second microwave split ring transmission line resonator, the third variable capacitor is connected between the second balanced output port and the lower portion of the second microwave split ring transmission line resonator.

In the microwave frequency tunable filtering balun according to present invention, the microwave frequency tunable filtering balun further comprises a first open-circuited microwave transmission line and a second open-circuited microwave transmission line arranged at a middle of the first microwave split ring transmission line resonator and the second microwave split ring transmission line resonator in a vertically symmetrical manner about the central line.

In the microwave frequency tunable filtering balun according to present invention, the first, second, third, fourth and fifth variable capacitors comprise a varactor diode and a DC block capacitor connected in series.

In the microwave frequency tunable filtering balun according to present invention, the first, second, third, fourth and fifth variable capacitors are semiconductor diodes or semiconductor transistors with capacitance varying functions.

In the microwave frequency tunable filtering balun according to present invention, the first microwave split ring transmission line resonator and the second microwave split ring transmission line resonator are split ring microstrip line resonators, split ring coplanar waveguide resonators or split ring slot line resonators.

By implementing the technical solution of present invention, difference passband frequency of the filtering balun changes via controlling capacitances of the fourth and fifth variable capacitors loaded between two open ends of the first and second microwave split ring transmission line resonators. In additional, by employing microwave split ring transmission line resonator symmetrically loaded with variable capacitors, the odd-mode and even-mode methods are applicable for analysis.

Furthermore, although the change of difference passband frequency will affect the insertion loss, the magnitude loss still can be reduced via adjusting capacitances of the variable capacitors added between the unbalanced input port/balanced output port and the resonator for impedance matching and loss compensation.

Thirdly, loading open-circuited microwave transmission line at the central line may obtain an additional transmission zero in the higher stopband without any influence on the bandpass response, increase depressing depth of the difference passband, and alter the position of the additional transmission zero via optimizing length of the open-circuited branch.

BRIEF DESCRIPTION OF THE DRAWINGS

Hereinafter, embodiments of present invention will be described in detail with reference to the accompanying drawings, wherein.

DETAILED DESCRIPTION

Figure 1:
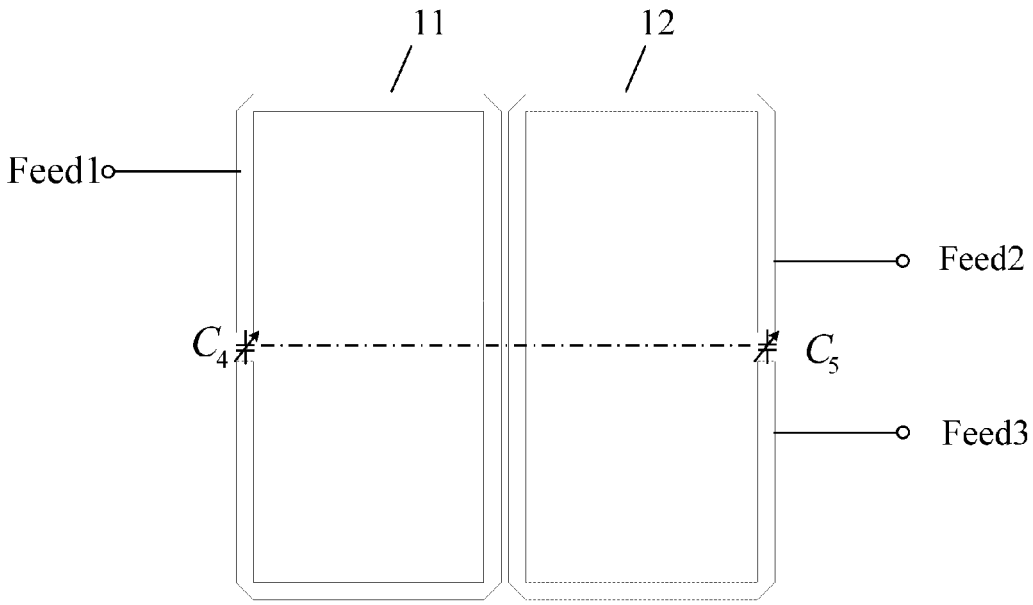
FIG. 1 is a circuit diagram of the microwave frequency tunable filtering balun according to a first embodiment of present invention.

As shown in FIG. 1, in microwave frequency tunable filtering balun according to a first embodiment of present invention, the microwave frequency tunable filtering balun comprises a first microwave split ring transmission line resonator 11 and a second microwave split ring transmission line resonator 12, a fourth variable capacitor $C_4$ and a fifth variable capacitor $C_5$. Wherein, the first microwave split ring transmission line resonator 11 and second microwave split ring transmission line resonator 12 are arranged in a bilaterally symmetrical manner. The fourth variable capacitor $C_4$ and fifth variable capacitor $C_5$ have same parameters, and the capacitances of the fourth variable capacitor $C_4$ and fifth variable capacitor $C_5$ are defined as $C_v$. The first microwave split ring transmission line resonator 11 and the second microwave split ring transmission line resonator 12 are vertically symmetrical about a central line (as shown in FIG. 1). It should be noted that, in present embodiment, the first microwave split ring transmission line resonator 11 and the second microwave split ring transmission line resonator 12 are connected as a square. Of course, the first microwave split ring transmission line resonator 11 and the second microwave split ring transmission line resonator 12 also can be connected as a circle, a hexagon, an octagon and so on. Furthermore, in present embodiment, the unbalanced input port Feed1 is arranged at a top portion of the first microwave split ring transmission line resonator 11, the first balanced output port Feed2 and the second balanced output port Feed3 are arranged in a vertically symmetrical manner at an upper portion and a lower portion of the second microwave split ring transmission line resonator 12 respectively. A distance between the first balanced output port Feed2 or the second balanced output port Feed3 and the central lines is smaller than a distance between the unbalanced input port Feed1 and the central line. The fourth variable capacitor $C_4$ is connected between two open ends of the first microwave split ring transmission line resonator 11 and the fifth variable capacitor $C_5$ is connected between two open ends of the second microwave split ring transmission line resonator 12.

Figure 2:
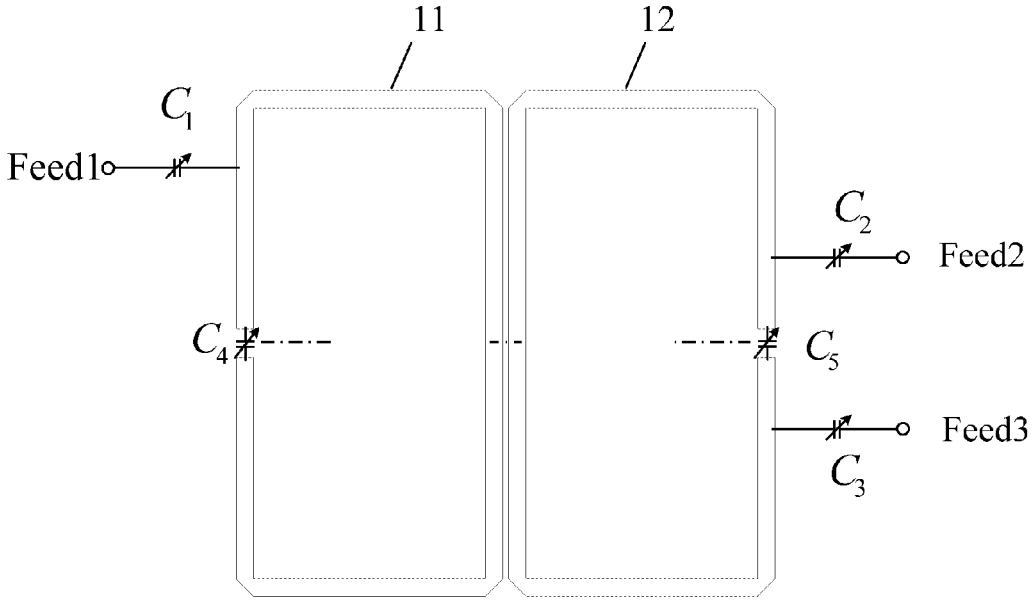
FIG. 2 is a circuit diagram of the microwave frequency tunable filtering balun according to a second embodiment of present invention.

As shown in FIG. 2, the microwave frequency tunable filtering balun according to a second embodiment of present invention is similar as that one shown in FIG. 1 and comprises a first microwave split ring transmission line resonator 11 and a second microwave split ring transmission line resonator 12, a fourth variable capacitor $C_4$, a fifth variable capacitor $C_5$, unbalanced input port Feed1, first balanced output port Feed2 and second balanced output port Feed3. Accordingly, such similar structures are not introduced in detail for conciseness. Now, only the difference between the embodiments in FIG. 1 and FIG. 2 is illustrated. The microwave frequency tunable filtering balun shown in FIG. 2 further comprises a first variable capacitor $C_1$, a second variable capacitor $C_2$ and a third variable capacitor $C_3$. The first terminal of the first variable capacitor $C_1$ is connected to the unbalanced input port Feed1, and the second terminal of the first variable capacitor $C_1$ is connected to the upper portion of the first microwave split ring transmission line resonator 11. The first terminal of the second variable capacitor $C_2$ is connected to the first balanced output port Feed2 and the second terminal of the second variable capacitor $C_2$ is connected to the upper portion of the second microwave split ring transmission line resonator 12. The first terminal of the third variable capacitor $C_3$ is connected to the second balanced output port Feed3 and second terminal of the third variable capacitor $C_3$ is connected to the lower portion of the second microwave split ring transmission line resonator 12.

Figure 3:
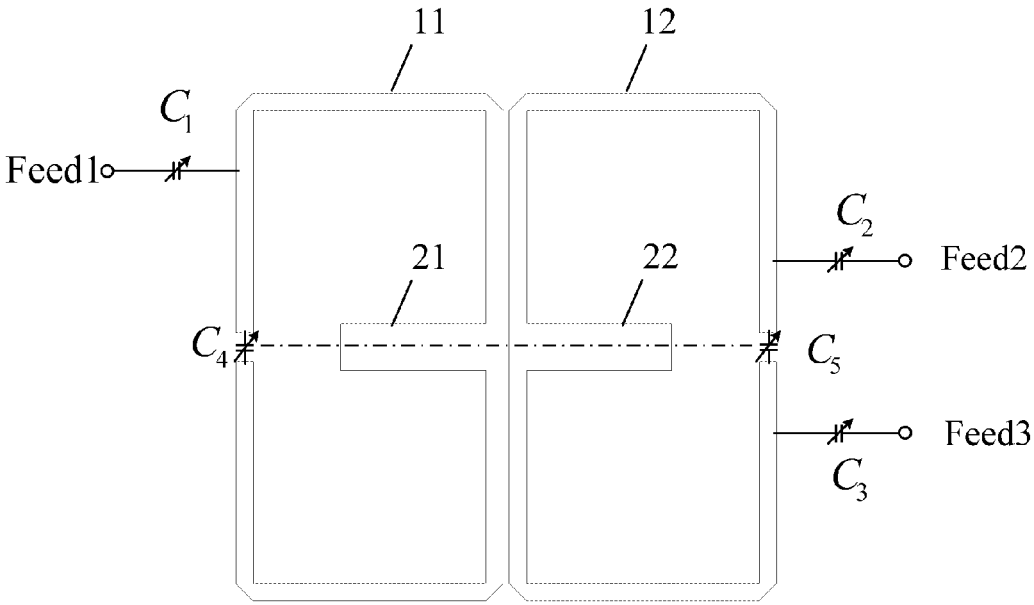
FIG. 3 is a circuit diagram of the microwave frequency tunable filtering balun according to a third embodiment of present invention.

As shown in FIG. 3, the microwave frequency tunable filtering balun according to a third embodiment of present invention is similar as that one shown in FIG. 2 and comprises a first microwave split ring transmission line resonator 11 and a second microwave split ring transmission line resonator 12, a first variable capacitor $C_1$, a second variable capacitor $C_2$, a third variable capacitor $C_3$, a fourth variable capacitor $C_4$, a fifth variable capacitor $C_5$, unbalanced input port Feed1, first balanced output port Feed2 and second balanced output port Feed3. Accordingly, such similar structures are not introduced in detail for conciseness. Now, only the difference between the embodiments in FIG. 2 and FIG. 3 is illustrated. The microwave frequency tunable filtering balun shown in FIG. 3 further comprises a first open-circuited microwave transmission line 21 arranged at the middle of the first microwave split ring transmission line resonator 11 in a vertically symmetrical manner about the central line and a second open-circuited microwave transmission line 22 arranged at the middle of the second microwave split ring transmission line resonator 12 in a vertically symmetrical manner about the central line.

The work principle of the microwave frequency tunable filtering balun is explained in detail as follows. At first, the odd- and even-mode methods are employed to analyze the microwave frequency tunable filtering balun, wherein, the capacitances of the fourth variable capacitor $C_4$ and fifth variable capacitor $C_5$ are defined as $C_v$, the capacitances of the first variable capacitor $C_1$, second variable capacitor $C_2$ and third variable capacitor $C_3$ are defined as $C_c$. It should be noted that, although the embodiment discussed below only taking the second microwave split ring transmission line resonator 12 as an example, one skilled in the art should understand that, the work principle is the same when taking the first microwave split ring transmission line resonator 11 as an example.

A. Odd-Mode Analysis

Figure 4:
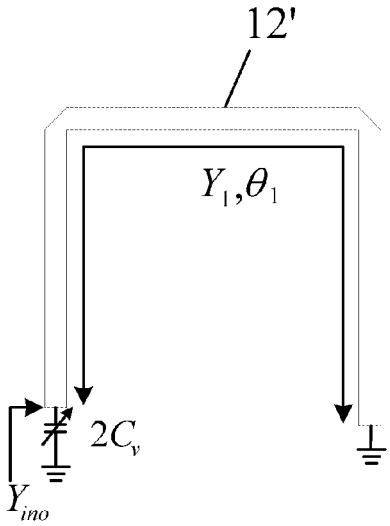
FIG. 4 is an odd mode equivalent circuit diagram of the microwave frequency tunable filtering balun according to present invention.

When the odd-mode excitation is applied to the feed points of the second microwave split ring transmission line resonator 12 (that is, the first balanced output port Feed2 and the second balanced output port Feed3), voltage at the central line of the second microwave split ring transmission line resonator 12 is equal to zero and short-circuited to the ground. Accordingly, second open-circuited microwave transmission line 22 loaded at the central line can be ignored. Accordingly, we can symmetrically bisect the fifth variable capacitor $C_5$ arranged at the two open ends of the second microwave split ring transmission line resonator 12 into two loading capacitors to achieve the odd-mode equivalent circuit 12' shown in FIG. 4. The odd-mode input admittance $Y_{ino}$ of the odd-mode equivalent circuit 12' can be obtained as:

$$Y_{ino} = 2j\omega C_v - \frac{Y_1}{j\tan\theta_1} \tag{1}$$

where $Y_1$ is the characteristic admittance of the second microwave split ring transmission line resonator 12, $\theta_1$ is the half electric length of the second microwave split ring transmission line resonator 12, $\omega$ is the angular velocity of the central frequency. According to the resonance condition, the imaginary part of $Y_{ino}$ is equal to zero, that is, $\mathrm{Im}\{Y_{ino}\}=0$. Therefore, the odd-mode resonant Frequency $f_{odd}$ can be expressed as $$f_{odd} = \frac{c}{2\pi L_1\sqrt{\varepsilon_{eff}}} \cdot \arctan\frac{Y_1}{2\pi\omega C_v} \tag{2}$$

Where $L_1$ is the half physical length of the second microwave split ring transmission line resonator 12, c is the velocity of light in free space, $\epsilon_{eff}$ is the effective permittivity. It can be found that odd-mode resonant frequency $f_{odd}$ corresponds to the fundamental resonant frequency of the resonator. As expected, the differential outputs of the microwave frequency tunable filtering balun can be achieved, while the shunt stub has no effect on odd-mode resonant frequency $f_{odd}$. The odd-mode resonant frequency $f_{odd}$ can be reduced by increasing capacitances $C_v$ of the fourth variable capacitor $C_4$ and fifth variable capacitor $C_5$ and be protected from the affect of the second open-circuited microwave transmission line 22 loaded at the central line at the same time. In additional, during the frequency tuning, better impedance matching and lower insertion loss can be obtained at the unbalanced input port and balanced output ports by increasing capacitances $C_c$ of the first variable capacitor $C_1$, second variable capacitor $C_2$ and third variable capacitor $C_3$, which enable the microwave frequency tunable filtering balun keeps lower insertion loss in the tuned difference passbands.

In other aspect, the balanced output ports Feed 2 and Feed 3 have smaller external quality factor than the unbalanced input port Feed 1 if the unbalanced input port and balanced output ports obtain same distance with respect to the central line. Accordingly, in order to guarantee that the microwave frequency tunable filtering balun has perfect passband filtering characteristics, the unbalanced input port Feed1 obtains smaller external quality factor by being far away from the central line, so that the unbalanced input port and the balanced output ports can have same external quality factors.

B. Even-Mode Analysis

Figure 5:
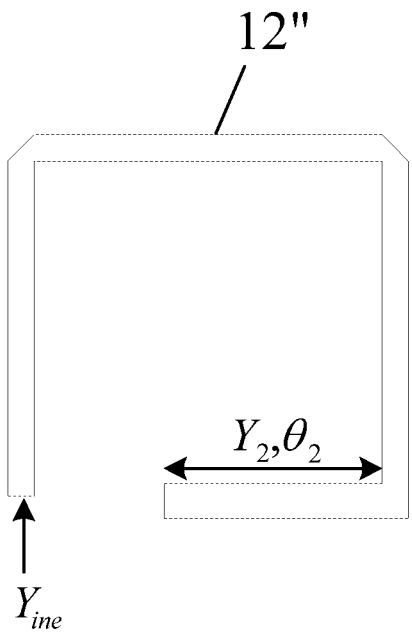
FIG. 5 is an even mode equivalent circuit diagram of the microwave frequency tunable filtering balun according to present invention.

When the even-mode excitation is applied to the feed points of the second microwave split ring transmission line resonator 12 (that is, the first balanced output port Feed2 and the second balanced output port Feed3), voltage at the central line of the second microwave split ring transmission line resonator 12 is equal to zero. Accordingly, we can symmetrically bisect the second microwave split ring transmission line resonator 12 and the second open-circuited microwave transmission line 22 loaded at the central line of the second microwave split ring transmission line resonator 12 into two portions to achieve the even-mode equivalent circuit 12" shown in FIG. 5. The even-mode input admittance $Y_{ine}$ of the even-mode equivalent circuit 12" can be obtained as:

$$Y_{ine} = jY_1\frac{Y_1\tan\theta_1 + Y_2\tan\theta_2}{Y_1\tan\theta_1 - Y_2\tan\theta_2\tan\theta_1} \tag{3}$$

where $Y_2$ is the characteristic admittance of the second open-circuited microwave transmission line 22 symmetrically bisected along the central line, $\theta_2$ is the electric length of the second open-circuited microwave transmission line 22. Scatter parameter $S_{21}$ from the unbalanced input port Feed1 to the first balanced output port Feed2 and scatter parameter $S_{31}$ from the unbalanced input port Feed1 to the second balanced output port Feed3 can be calculated from the Y-parameters from formula (1) and (3) and expressed as:

$$S_{21} = S_{31} = \frac{Y_{ino} - Y_{ine}}{(1 + Y_{ino})(1 + Y_{ine})} \tag{4}$$

Then, the ATZ (additional transmission zero) can be obtained when $S_{21}=S_{31}=0$. For simplifying the analysis, assuming $Y_1 \cong Y_2$ $$\tan\theta_2 = \frac{2\omega C_v\tan\theta_1 + Y_1 - Y_1\tan\theta_1}{2\omega C_v\tan\theta_1 + 2Y_1} \tag{5}$$

As a result, the ATZ frequency can be attained as $$f_{ATZ} = \frac{c\cdot\theta_2}{2\pi L_2\sqrt{\varepsilon_{eff}}} \tag{6}$$

Where, $L_2$ is the physical length of the second open-circuited microwave transmission line 22. From formula (5) and (6), it can be found that not only the odd-mode resonant frequency $f_{odd}$ but also the ATZ frequency $f_{ATZ}$ are controlled by the capacitances $C_v$ of the fourth variable capacitor $C_4$ and fifth variable capacitor $C_5$. The ATZ frequency $f_{ATZ}$ is controlled by the physical length $L_2$ of the second open-circuited microwave transmission line 22 loading at the central line when the half physical length $L_1$ of the second microwave split ring transmission line resonator 12 and the capacitances $C_v$ of the fifth variable capacitor $C_5$ are fixed.

Figure 6:
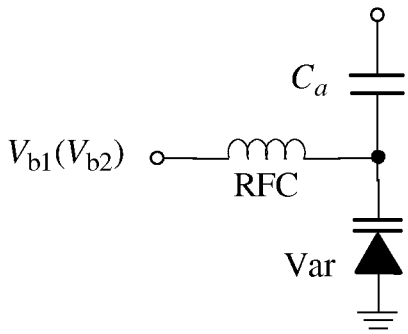
FIG. 6 is an equivalent circuit diagram of the variable capacitor in the microwave frequency tunable filtering balun according to the first embodiment of present invention, when testing.

The first variable capacitor $C_1$, second variable capacitor $C_2$, third variable capacitor $C_3$, fourth variable capacitor $C_4$ and fifth variable capacitor variable capacitor $C_5$ comprise a varactor diode and a DC block capacitor connected in series. As the equivalent circuit diagrams of the variable capacitors when testing shown in FIG. 6, wherein, RFC (RF Choke) is used for isolation between DC bias voltage ($V_{b1}$ and $V_{b2}$) and RF signal. Varactor diodes Var and ordinary DC block capacitor $C_a$ connected in series can be used as the variable capacitors $C_1$-$C_5$. The detail variable capacitance can be expressed by the following formula:

$$C_v = \frac{C_{v1}C_a}{C_{v1}+C_a},\ C_c = \frac{C_{v2}C_a}{C_{v2}+C_a} \quad (7)$$

Wherein, $C_{v1}$ and $C_{v2}$ represent the capacitances of the varactor diode, and the capacitance changes with the DC bias voltage ($V_{b1}$ and $V_{b2}$). As the varactor diodes on the market have various tunable capacitances ranges with different capacitance values, the varactor diode and DC block capacitor should be seriously considered and selected. Accordingly, the varactor diode Toshiba JDV2S71E with tunable capacitance 0.58→8.5 pF is selected according to present invention. Of course, in other embodiment of present invention, the first variable capacitor $C_1$, second variable capacitor $C_2$, third variable capacitor $C_3$, fourth variable capacitor $C_4$ and fifth variable capacitor variable capacitor $C_5$ can be semiconductor diodes or semiconductor transistors with capacitance varying functions.

Figure 7:
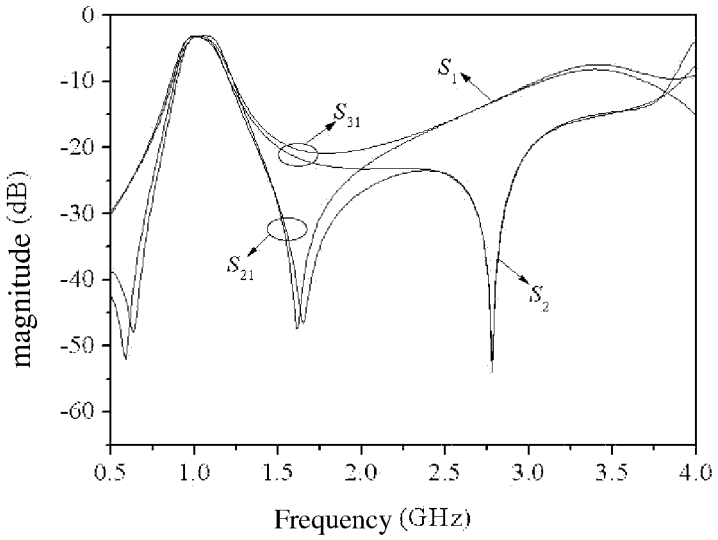
FIG. 7 is a graph of magnitude-frequency response of the microwave frequency tunable filtering balun under open-circuited microwave transmission line with different lengths.

FIG. 7 is a graph of magnitude-frequency response of the microwave frequency tunable filtering balun under open-circuited microwave transmission line with different length. Wherein, curves $S_{21}$ and $S_{31}$ each represents magnitude-frequency response simulation curve of the first balanced output port Feed2 or the second balanced output port Feed3. Curve $S_1$ represents frequency response simulation curve without loading open-circuited microwave transmission line ($L_2$=0). As shown in FIG. 7, curves $S_{21}$ and $S_{31}$ float continuously outside the passband, and there is no ATZ. Curve $S_2$ represents frequency response simulation curve loading open-circuited microwave transmission line ($L_2$=5 mm). As shown in FIG. 7, there is ATZ generated at 2.8 GHz. Accordingly, loading open-circuited microwave transmission line at the central line may obtain an additional transmission zero in the higher stopband without any influence on the bandpass response, increase depressing depth of the difference passband, and alter the position of the additional transmission zero via optimizing length of the open-circuited branch.

Figure 8:
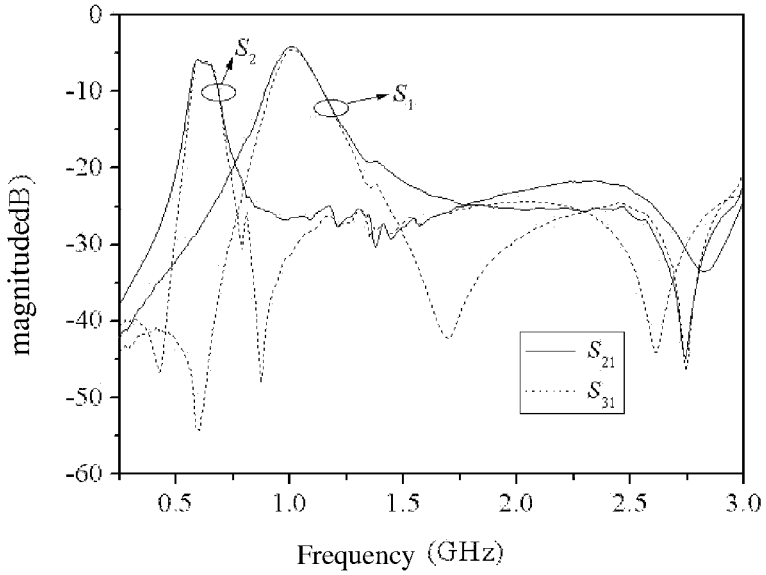
FIG. 8 is a graph of magnitude-frequency response of the microwave frequency tunable filtering balun under different bias voltages.

FIG. 8 is a graph of magnitude-frequency response of the microwave frequency tunable filtering balun under different bias voltages. Wherein, curve $S_1$ represents actual magnitude-frequency response of the microwave frequency tunable filtering balun when $V_{b1}$=25V and $V_{b2}$=13V, and the difference passband has a central frequency of 1.03 GHz. Curve $S_2$ represents actual magnitude-frequency response of the microwave frequency tunable filtering balun when $V_{b1}$=5V and $V_{b2}$=6V, and the difference passband has a central frequency of 0.593 GHz. As shown in FIG. 8, the measured center frequency of passband is continuously decreased from 1.03 to 0.593 GHz as $V_{b1}$ reduces from 25V to 5V, that is capacitances $C_v$ increases. Meanwhile, $V_{b2}$ reduces from 13V to 6V, that is capacitances $C_c$ increases for the loss compensation.

TABLE I

EXPERIMENTAL PERFORMANCE

| | | Maximum Imbalance | |
|---|---|---|---|
| $V_{b1}$ (V) | Passband (MHz) | Amplitude (dB) | Phase (deg.) |
| 25 | 965-1118 | 0.23 | 0.67 |
| 15 | 832-986 | 0.12 | 1.62 |
| 10 | 740-881 | 0.26 | 2.68 |
| 7 | 642-768 | 0.27 | 3.86 |
| 5 | 565-677 | 0.34 | 4.65 |

In additional, the first microwave split ring transmission line resonator 11 and the second microwave split ring transmission line resonator 12 are split ring microstrip line resonators, split ring coplanar waveguide resonators or split ring slot line resonators.

The foregoing description of the exemplary embodiments of the invention has been presented only for the purposes of illustration and description and is not intended to be exhaustive or to limit the invention to the precise forms disclosed. Any modifications and variations are possible in light of the above teaching without departing from the protection scope of the present invention.

What is claimed:

1. A microwave frequency tunable filtering balun, comprising a first microwave split ring transmission line resonator and a second microwave split ring transmission line resonator arranged in a bilaterally symmetrical manner, a fourth variable capacitor and a fifth variable capacitor of same parameters, wherein, the first microwave split ring transmission line resonator and the second microwave split ring transmission line resonator are vertically symmetrical about a central line, an unbalanced input port is arranged at a top portion of the first microwave split ring transmission line resonator, a first balanced output port and a second balanced output port are arranged in a vertically symmetrical manner at an upper portion and a lower portion of the second microwave split ring transmission line resonator respectively, a distance between the first balanced output port or the second balanced output port and the central lines is smaller than a distance between the unbalanced input port and the central line, the fourth variable capacitor is connected between two open ends of the first microwave split ring transmission line resonator and the fifth variable capacitor is connected between two open ends of the second microwave split ring transmission line resonator.

2. The microwave frequency tunable filtering balun according to claim 1, further comprising a first variable capacitor, a second variable capacitor and a third variable capacitor, wherein, the first variable capacitor is connected between the unbalanced input port and the upper portion of the first microwave split ring transmission line resonator, the second variable capacitor is connected between the first balanced output port and the upper portion of the second microwave split ring transmission line resonator, the third variable capacitor is connected between the second balanced output port and the lower portion of the second microwave split ring transmission line resonator.

3. The microwave frequency tunable filtering balun according to claim 1, further comprising a first open-circuited microwave transmission line and a second open-circuited microwave transmission line arranged at a middle of the first microwave split ring transmission line resonator and the second microwave split ring transmission line resonator in a vertically symmetrical manner about the central line.

4. The microwave frequency tunable filtering balun according to claim 2, further comprising a first open-circuited microwave transmission line and a second open-circuited microwave transmission line arranged at a middle of the first microwave split ring transmission line resonator and the second microwave split ring transmission line resonator in a vertically symmetrical manner about the central line.

5. The microwave frequency tunable filtering balun according to claim 2, wherein the first, second, third, fourth and fifth variable capacitors comprise a varactor diode and a DC block capacitor connected in series.

6. The microwave frequency tunable filtering balun according to claim 2, wherein the first, second, third, fourth and fifth variable capacitors are semiconductor diodes or semiconductor transistors with capacitance varying functions.

7. The microwave frequency tunable filtering balun according to claim 1, wherein the first microwave split ring transmission line resonator and the second microwave split ring transmission line resonator are split ring microstrip line resonators, split ring coplanar waveguide resonators or split ring slot line resonators.

* * * * *